United States Patent [19]

Grisik et al.

[11] 4,148,936

[45] Apr. 10, 1979

[54] METHOD FOR DIFFUSION COATING AN Fe-Ni BASE ALLOY WITH CHROMIUM

[75] Inventors: John J. Grisik, Middletown; David J. Wortman, West Chester, both of Ohio

[73] Assignee: General Electric Company, Cincinnati, Ohio

[21] Appl. No.: 853,799

[22] Filed: Nov. 21, 1977

Related U.S. Application Data

[62] Division of Ser. No. 753,949, Dec. 23, 1976.

[51] Int. Cl.[2] ..... C23C 11/04; C23C 9/02

[52] U.S. Cl. ..... 427/253; 428/667

[58] Field of Search ..... 427/253; 428/667

[56] References Cited

U.S. PATENT DOCUMENTS

| | | | |
|---|---|---|---|
| 2,899,332 | 8/1959 | Samuel | 427/253 |
| 3,065,108 | 11/1962 | Seelig et al. | 427/253 |
| 3,649,225 | 3/1972 | Simmons | 428/938 |
| 3,656,919 | 4/1972 | Lucas et al. | 428/667 |
| 3,694,255 | 9/1972 | Brill-Edwards | 427/253 |
| 3,779,719 | 12/1973 | Clark et al. | 427/253 |
| 3,785,854 | 1/1974 | Baldi | 148/6.27 |
| 3,812,566 | 5/1974 | Clauss | 428/667 |
| 3,957,454 | 5/1976 | Bessen | 428/680 |
| 3,998,603 | 12/1976 | Rairden | 428/667 |
| 4,006,011 | 2/1977 | Muzyka et al. | 75/123 K |

FOREIGN PATENT DOCUMENTS

| | | | |
|---|---|---|---|
| 1070158 | 5/1967 | United Kingdom | 428/667 |

*Primary Examiner*—Ralph S. Kendall
*Attorney, Agent, or Firm*—Lee H. Sachs; Derek P. Lawrence

[57] ABSTRACT

A metallic article of a Fe—Ni base, controlled linear thermal expansion alloy is provided with improved environmental resistance without detriment to mechanical properties through the application to and diffusion into the article surface of Cr with or without other coating metals such as Ni. The coating is preferably applied through the pack diffusion method.

1 Claim, No Drawings

METHOD FOR DIFFUSION COATING AN Fe-Ni BASE ALLOY WITH CHROMIUM

The invention herein described was made in the course of or under a contract, or a subcontract thereunder, with the United States Department of the Air Force.

This is a divisional of application Ser. No. 753,949, filed Dec. 23, 1976, and is assigned to the assignee of the present invention.

FIELD OF THE INVENTION

This invention relates to the metallic coating of heat resistant alloys and, more particularly, to coated articles of controlled linear thermal expansion alloy diffusion coated for environmental protection.

BACKGROUND OF THE INVENTION

Controlled linear thermal expansion alloys, some forms of which have been identified as Incoloy 903(IN903) alloy, CTX I alloy and CTX II alloy have potential use in advanced gas turbine engines. Such alloys possess unique thermal expansion characteristics which can improve specific fuel consumption by maintaining closer operating tolerances. For example, articles which can be made from such alloys include seals, shroud supports and hangers, as well as turbine casings. Such an alloy is characterized as having an inflection, or significant change, in its mean coefficient of linear thermal expansion in its curie temperature range.

One characteristic of such alloys is that Cr has not been added as an alloying element, although it may be includes as an impurity up to about 1 weight percent. Therefore, the environmental resistance of such alloys is relatively poor. As a result, a protective coating is required for application of such alloys in gas turbine engines.

The mechanical properties of such alloys have been found to be sensitive to the environment, particularly in the recrystallized condition. Additionally, stress accelerated grain boundary oxidation is believed to contribute to the sensitivity of the mechanical properties to the environment and microstructure. Therefore, a suitable coating is required to retain the mechanical properties of such alloys, particularly of the recrystallized material.

It is a principal object of the present invention to provide an article of a controlled linear thermal expansion alloy, the surface of which has been provided with environmental resistance.

Another object is to provide a method for making such an article without recrystallizing its microstructure.

These and other objects and advantages will be more clearly understood from the following detailed description and examples which are intended to be typical of rather than in any way limiting on the scope of the present invention.

Briefly, the present invention, in one form, provides a metallic article comprising an Fe—Ni base alloy substrate of the controlled linear thermal expansion type, characterized by the substantial absence of Cr and having a mean coefficient of linear thermal expansion of less than about 4.7 inches $\times 10^{-6}$ per inch per °F. (8.5 mm $\times 10^{-6}$ per mm per °C.) at the inflection temperature in the range of about 780–880° F. (416–471° C.) In one form, such alloy consists essentially of, by weight, 30–40% Ni, 10–20% Co, 1–5% of the sum of Cb and Ta, 0.5–3% Ti, 0.2–3% Al, up to about 3% each of Hf and Zr, up to about 0.5% B, with the balance essentially Fe and incidental impurities, the substrate having diffused therein a material selected from Cr and its alloys. In a preferred form, such alloy substrate consists essentially of, by weight 35–40% Ni, 13–17% Co, 2–4% of the sum of Cb and Ta, 1–2% Ti, 0.3–1.2% Al, up to 3% Hf, with the balance Fe and incidental impurities. It is preferred that such impurities be maintained in a range up to a maximum of 0.012% B, 0.05% Cu, 0.06% C, 1% Mn, 0.35% Si, 0.015% S, 0.015% P and 1% Cr.

According to the method associated with the present invention, such coated metallic article is provided by diffusion chromiding the article surface in a container with a non-oxidizing, preferably reducing atmosphere such as $H_2$, and a powdered mixture comprising, by weight, 10–50% Cr powder, 0.1–4% of a conventional halide salt activator, particularly a chloride type such as $NH_4Cl$ or $CrCl_3$, with the balance of the mixture being an inert powder filler such as $Al_2O_3$. Preferably such mixture consists essentially of, by weight, 15–25% Cr, 1.5–2.5% of a chloride salt activator, with the balance $Al_2O_3$. Such a method is conducted at a temperature below that which will recrystallize such an alloy, generally less than 1700° F. and preferably in the range of about 1450–1650° F.

DESCRIPTION OF THE PREFERRED EMBODIMENTS

During the evaluation of the present invention, a commercially available, controlled linear thermal expansion alloy identified as IN903 was selected as being typical of available controlled linear thermal expansion alloys which could be applied as articles for gas turbine engines. Selected for evaluation with the present invention were a variety of coatings including the widely used aluminide type of coatings.

In one evaluation, specimens of IN903 alloy were aluminided in a commercially available Fe—Al base pack aluminiding process to generate a coating referred to as A-12 coating, at a temperature of 1250° F. in order to avoid recrystallization. The A-12 coating includes a non-metallic conversion coating applied over the diffused aluminide coating at a temperature below 1250° F. The total thickness of the additive portion of the coating was measured as 0.0005", with a diffusion zone of up to 0.001".

The effect of aluminum-containing coatings on the mechanical properties of IN903 alloy was demonstrated during stress rupture testing at 1200° F., 85 ksi. The life of the bare specimen was 115 hours whereas the life of the A-12 aluminide coated specimen was 20 hours. Such degradation is believed to be caused by inward aluminum diffusion causing precipitation of embrittling phases in the grain boundaries of the substrate.

Duplicate IN903 alloy specimens were given an environmental protection by chromiding in a powder pack within the composition range, by weight, of 10–50% Cr powder, 0.1–4% of a halogen activator, with the balance an inert powder binder such as alumina. In this particular series of evaluations, the pack consisted nominally, by weight, of 20% commercially pure Cr powder within the preferred range of 15–25% Cr, 2% $NH_4Cl$ within the preferred range of 1.5–2.5% chloride activator, with the balance $Al_2O_3$ powder. Chromiding was conducted for 4 hours at a temperature of about 1550° F. within the range of 1450–1650° F., below the recrystallization temperature of IN903 alloy. The resultant diffusion coating was at least about 80% Cr, with the balance being elements from the alloy substrate. Coating thickness varied from 0.0002–0.0005" in thickness.

Environmental resistance of a controlled linear thermal expansion type alloy protected by a chromide surface was demonstrated by oxidation testing performed on coated and uncoated IN903 alloy specimens at 1000, 1200 and 1400° F. in static air. Non-cyclic test results on uncoated specimens after 250 hours showed oxide penetration at 1200° F. of more than 0.001" and at 1400° F. more than 0.0055". By way of comparison, the chromided specimens showed no penetration under those same conditions after 500 hours of exposure. Cyclic salt spray testing, wherein a cycle was 20 hours at 1000° F. followed by 20 hours in the salt spray cabinet, showed the life of a chromided IN903 alloy specimen to be about 6 times longer than that of an uncoated specimen.

From these typical evaluation data, it can be seen that an article of a controlled linear thermal expansion alloy substrate into which has been diffused the element Cr at a temperature less than its recrystallization temperature is characterized by significantly improved environmental resistance without degradation of mechanical properties. For example, in comparative stress rupture testing on unrecrystallized IN903 alloy specimens, the following data were generated: in high stress, short time testing at 100 ksi, 1200° F., the coated and uncoated specimens had the same average life of 0.8 hours; in low stress, long time testing (the type which would be experienced by articles of such an alloy in gas turbine engine applications), at 80 ksi, 1000° F., the uncoated specimen life averaged about 90 hours whereas the coated specimens averaged 200 hours.

In another series of evaluations, Ni was chemically deposited on IN903 alloy specimens from an aqueous solution commercially available as NIKLAD755 Electroless Nickel from which it produced a uniform Ni coating to a thickness of about 0.0005" on IN903 alloy specimens. After a 100° F. diffusion anneal, oxidation resistance of the coated specimens was found to be poor. Application of a commercial aluminum silicate type of diffusion barrier over a nickel coating did not provide adequate additional oxidation resistance: spalling of the aluminum silicate coating and penetration of oxides into the base metal was observed. For example, such coating failed in less than 250 hours at 1200° F. in the above-described oxidation test. However, when the nickel-coated specimens were chromided as described above, the oxidation resistance was significantly enhanced as evidenced by no measurable loss of coating or attack of the base metal after 500 hours at 1400° F.

Thus, the present invention, in one form, provides an article made of an iron-nickel base controlled linear thermal expansion alloy substrate having diffused therein a material which is either Cr or an alloy of Cr such as a combination of Cr and Ni. The method associated with the present invention provides diffusion application of Cr through a pack-type process employing a particular powdered mixture which can perform at a temperature less than the recrystallization temperature of the alloy substrate.

Although the present invention has been described in connection with specific examples and embodiments, it will be recognized by those skilled in the art the variations and modifications of which the present invention is capable.

What is claimed is:

1. A method for making an article consisting essentially of an Fe—Ni base alloy of the controlled linear thermal expansion type characterized by the substantial absence of Cr, having an inflection in its mean coefficient of linear thermal expansion in its curie temperature range, and having a mean coefficient of linear thermal expansion of less than about 4.7 inches X $10^{-6}$ per inch per °F. at the inflection temperature, the alloy consisting essentially of, by weight, 30–40% Ni, 10–20% Co, 1–5% of the sum of Cb and Ta, 0.5–3% Ti, 0.2–3% Al, up to about 3% Hf, up to about 3% Zr, up to about 0.5% B, with the balance Fe and incidental impurities, a surface of the alloy having diffused therein a coating of a material selected from the group consisting of Cr and alloys of Cr and Ni, comprising the steps of:

providing a powder mixture, by weight of 15–25% Cr powder, 1.5–2.5% of a chloride salt activator, with the balance alumina powder;

placing the article and the powder mixture in a container with a non-oxidizing atmosphere; and then, heating the article and the mixture at a temperature in the range of about 1450–1650° F. for a time sufficient for Cr to deposit on and diffuse into the surface.

* * * * *